US010238246B2

(12) United States Patent
Cittadino et al.

(10) Patent No.: US 10,238,246 B2
(45) Date of Patent: Mar. 26, 2019

(54) SHEET PRODUCT DISPENSER WITH LOAD INDUCEMENT PORTION

(71) Applicant: GPCP IP Holdings LLC, Atlanta, GA (US)

(72) Inventors: Antonio M. Cittadino, Appleton, WI (US); Steven B. Mattheeussen, Greenville, WI (US); Tom Muday, Scottsdale, AZ (US)

(73) Assignee: GPCP IP Holdings LLC, Atlanta, GA (US)

( * ) Notice: Subject to any disclaimer, the term of this patent is extended or adjusted under 35 U.S.C. 154(b) by 524 days.

(21) Appl. No.: 13/904,128

(22) Filed: May 29, 2013

(65) Prior Publication Data

US 2013/0320128 A1 Dec. 5, 2013

Related U.S. Application Data

(60) Provisional application No. 61/652,508, filed on May 29, 2012.

(51) Int. Cl.
*A47K 10/38* (2006.01)
*A47K 10/36* (2006.01)

(52) U.S. Cl.
CPC ..... *A47K 10/38* (2013.01); *A47K 2010/3675* (2013.01); *A47K 2010/3863* (2013.01)

(58) Field of Classification Search
CPC .... A47K 10/36; A47K 10/38; A47K 10/3836; A47K 10/3827; Y10T 225/246
See application file for complete search history.

(56) References Cited

U.S. PATENT DOCUMENTS 316,368 A * 4/1885 Johnson ..... B65H 35/0026 225/22
405,121 A * 6/1889 Ross ..... 225/71
408,752 A * 8/1889 Ross ..... A47K 10/38 225/38

(Continued)

FOREIGN PATENT DOCUMENTS

DE 3310384 A1 10/1983
EP 0170768 A1 2/1986

(Continued)

OTHER PUBLICATIONS

International Search Report and Written Opinion of the International Searching Authority of PCT/US2013/043000, dated Aug. 2, 2013.

*Primary Examiner* — Michael E Gallion
(74) *Attorney, Agent, or Firm* — Eversheds Sutherland (US) LLP

(57) ABSTRACT

A sheet product dispenser for dispensing a roll of sheet product mounted thereto includes a housing portion and a load inducement portion. The housing portion defines a space operative to receive the roll of sheet product for rotation about an axis to dispense the sheet product. The load inducement portion is operative to induce a frictional force between the roll of sheet product and the load inducement portion during rotation of the roll of sheet product. The load inducement portion includes a guide member, and a load member slidably engaged with the guide member and operative to contact and apply a load to an outer surface of the roll of sheet product.

22 Claims, 10 Drawing Sheets

(56) References Cited

U.S. PATENT DOCUMENTS 417,592 A * 12/1889 Seymour, Jr. ..... A47K 10/38 225/71
424,788 A * 4/1890 Hubbell ..... A47K 10/38 225/71
429,029 A * 5/1890 Geltz ..... 225/67
432,107 A * 7/1890 Yarger ..... A47K 10/38 225/71
436,789 A 9/1890 Jobes
446,011 A * 2/1891 Pickles ..... B26F 3/02 225/70
448,113 A * 3/1891 Bolton ..... A47K 10/38 225/71
451,685 A * 5/1891 Tracy ..... A47K 10/38 225/71
452,719 A * 5/1891 Ross ..... 225/74
476,689 A * 6/1892 Sentman ..... B65H 35/0026 225/22
648,837 A * 5/1900 Blue ..... A47K 10/38 225/71
807,353 A * 12/1905 Bretz ..... B65H 35/0006 225/67
1,063,787 A * 6/1913 Evans ..... A47K 10/38 225/79
1,391,326 A * 9/1921 Killian ..... 242/599
1,624,235 A * 4/1927 Hall ..... 225/68
1,952,374 A * 3/1934 Hill ..... B65H 35/0006 225/23
2,416,585 A * 2/1947 Holub ..... 242/156.1
2,650,773 A * 9/1953 Fanning ..... A47K 10/38 242/422.5
2,699,903 A 1/1955 Montgomery
2,739,840 A * 3/1956 Anderson ..... A47K 10/22 239/52
2,749,056 A * 6/1956 Jenkins ..... 242/422.5
2,818,221 A * 12/1957 Thieman ..... 225/67
3,246,937 A * 4/1966 Galbraith ..... 312/34.22
3,494,518 A * 2/1970 Goss ..... 225/34
3,516,615 A 6/1970 Wickenberg
3,649,447 A * 3/1972 Turner ..... 162/271
3,709,445 A * 1/1973 Adams ..... 242/596.2
3,770,221 A 11/1973 Stern
3,850,379 A 11/1974 Stern
3,918,661 A * 11/1975 Kishi et al. ..... 242/422.5
4,093,138 A * 6/1978 Shafer ..... 242/422.5
4,285,474 A 8/1981 Perez
4,307,829 A * 12/1981 Stoveken ..... B65H 35/008 225/67
4,610,407 A 9/1986 Stubbmann
4,660,781 A 4/1987 Hazard
4,706,844 A 11/1987 Omdoll et al.
4,714,210 A 12/1987 Howell
4,721,267 A 1/1988 Nieto et al.
4,771,966 A * 9/1988 Anderson ..... 242/422.5
4,781,316 A * 11/1988 Freeberg ..... A47K 10/38 225/71
4,846,415 A 7/1989 Jernberg et al.
4,919,350 A 4/1990 Miller
5,054,675 A 10/1991 Taves
5,054,706 A 10/1991 Maurice
5,135,179 A 8/1992 Morano
5,205,454 A 4/1993 Schutz et al.
5,452,832 A 9/1995 Niada
5,651,487 A * 7/1997 Hansen ..... 225/106
5,755,397 A 5/1998 Freese
5,788,136 A 8/1998 Othman
5,938,142 A 8/1999 Halperin
5,988,561 A 11/1999 Mele
6,098,919 A 8/2000 Lewis
6,267,322 B1 7/2001 Harmathy
6,648,265 B2 * 11/2003 Goldberg ..... 242/422.5
6,666,364 B2 12/2003 Phelps
6,786,377 B1 * 9/2004 Holden ..... 225/106
6,805,271 B2 10/2004 Holden
6,883,695 B2 * 4/2005 Orihara ..... 225/46
7,063,245 B2 6/2006 Faulks et al.
7,090,106 B2 8/2006 Holden
7,350,742 B1 * 4/2008 Mariano et al. ..... 242/598.3
7,438,257 B2 * 10/2008 Kennard ..... 242/598.5
7,530,526 B1 * 5/2009 Powers ..... 242/598.5
7,537,180 B2 5/2009 Morand
D635,806 S * 4/2011 Bodum ..... D6/521
8,162,252 B2 * 4/2012 Cittadino et al. ..... 242/560
8,584,982 B2 * 11/2013 Eakin ..... 242/598.5
2002/0100786 A1 * 8/2002 Orihara ..... 225/46
2002/0130211 A1 * 9/2002 Kerr ..... 242/422.5
2008/0087759 A1 * 4/2008 Cittadino et al. ..... 242/598.4
2008/0128448 A1 * 6/2008 Cittadino et al. ..... 221/11
2011/0108598 A1 * 5/2011 Bruner ..... 225/10
2012/0256036 A1 10/2012 Osborne
2013/0079923 A1 * 3/2013 Cittadino et al. ..... 700/232

FOREIGN PATENT DOCUMENTS

EP 2586349 A1 5/2013
FR 2621304 A1 4/1989
JP 2004208765 A 7/2004
KR 20070021240 A 2/2007
WO 2005120985 A1 12/2005
WO 2009050699 A1 4/2009

* cited by examiner

SHEET PRODUCT DISPENSER WITH LOAD INDUCEMENT PORTION

CROSS-REFERENCE TO RELATED APPLICATIONS

This application claims the benefit of U.S. Provisional Application No. 61/652,508, filed on May 29, 2012, which is incorporated herein by reference in its entirety.

BACKGROUND

The subject matter disclosed herein relates to the field of sheet product dispensing devices.

Previous sheet product dispensing devices include a spindle that defines an axis of rotation for a roll of sheet product. In operation a user pulls the sheet product to draw sheet product off of the roll and out of the dispenser. The force applied by the user rotates the roll. The force applied by the user to affect the rotation of the roll may vary depending on the mass and diameter of the roll.

BRIEF SUMMARY

In an exemplary embodiment, a sheet product dispenser for dispensing a roll of sheet product mounted thereto includes a housing portion and a load inducement portion. The housing portion defines a space operative to receive the roll of sheet product for rotation about an axis to dispense the sheet product. The load inducement portion is operative to induce a frictional force between the roll of sheet product and the load inducement portion during rotation of the roll of sheet product. The load inducement portion includes a guide member, and a load member slidably engaged with the guide member and operative to contact and apply a load to an outer surface of the roll of sheet product.

In another exemplary embodiment, a sheet product dispenser for dispensing a roll of sheet product mounted thereto includes a housing portion and a load inducement portion. The housing portion defines a space operative to receive the roll of sheet product for rotation about an axis to dispense the sheet product. The load inducement portion is operative to contact and apply a load to an outer surface of the roll of sheet product due to a force of gravity.

In a further exemplary embodiment, a method of dispensing a roll of sheet product mounted to a sheet product dispenser includes contacting and applying a load to an outer surface of the roll of sheet product with a load inducement portion of the sheet product dispenser due to a force of gravity. The method also includes rotating the roll of sheet product about an axis within a space defined by a housing portion of the sheet product dispenser to dispense the sheet product.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

Figure 1:
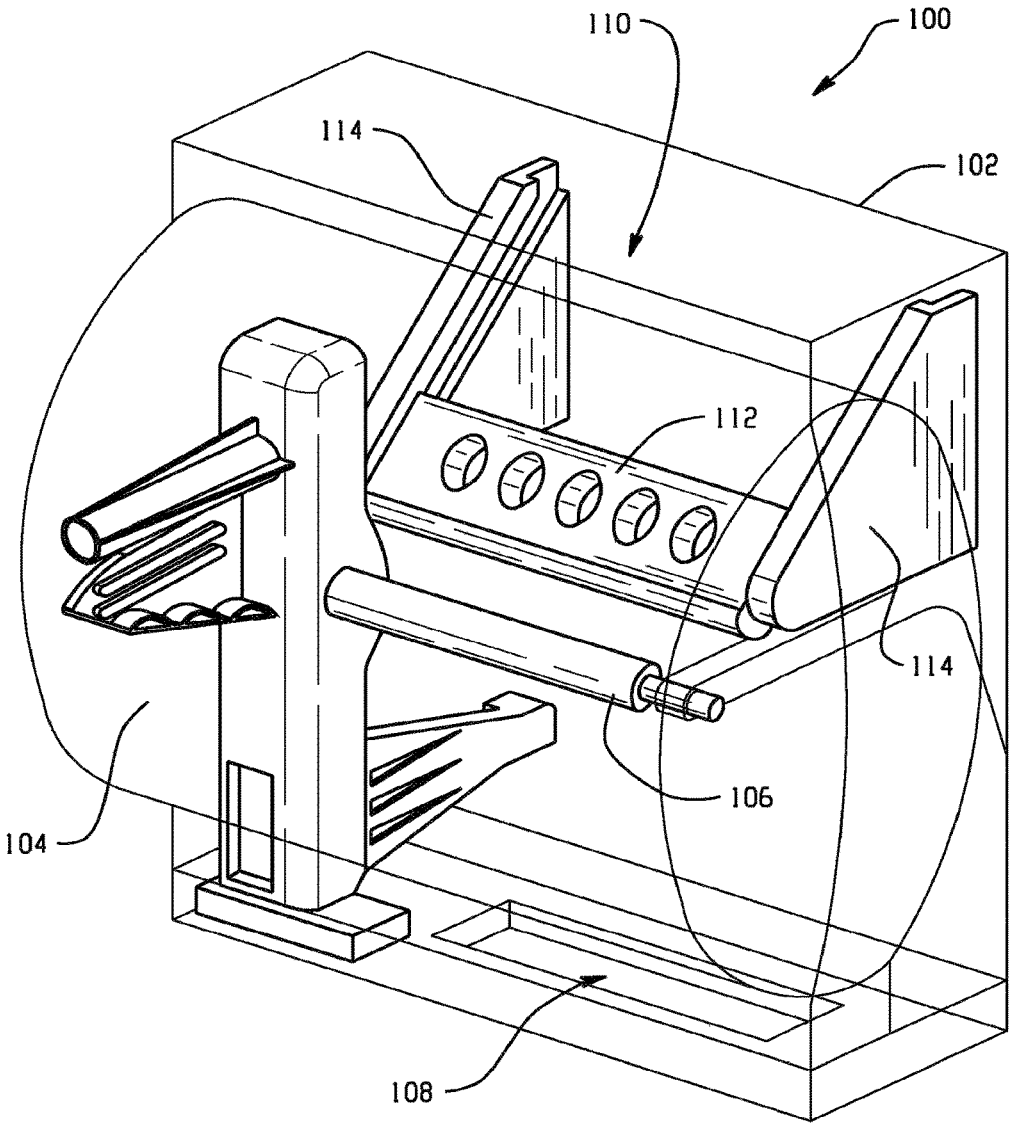
FIG. 1 illustrates a perspective, partially transparent view of an exemplary embodiment of a sheet product dispenser.

The detailed description explains embodiments of the invention, together with advantages and features, by way of example with reference to the drawings.

DETAILED DESCRIPTION

Sheet product dispensing devices often include a spindle that provides support for a roll of sheet product that may rotate about an axis of rotation defined by the spindle. In operation, a user withdraws sheet product from the dispenser by drawing the sheet product from the roll. The force applied to the sheet product results in the rotation of the roll about the spindle. When the roll is full or un-depleted, the relatively large mass and outer diameter of the roll may result in an undesirable "overspin" due to inertia as the roll rotates about the spindle and the moment arm of the force applied by the user. The overspin may result in the dispensing of an undesired or unneeded amount of sheet product, which ultimately may result in higher sheet product consumption per usage occasion. Over time, the mass and outer diameter of the roll decreases as users remove more sheet product from the roll. The reduction in mass and the outer diameter of the roll reduces the propensity of overspin responsive to the force that a user may apply to the sheet product to remove sheet product from the dispenser. Thus, a dispenser that is less susceptible to overspin due to a force applied by a user to affect the dispensing of a sheet product as the roll of sheet product is depleted is desired.

The term "sheet products" as used herein is inclusive of natural and/or synthetic cloth or paper sheets. Sheet products may include both woven and non-woven articles. There are a wide variety of nonwoven processes and they can be either wetlaid or drylaid. Some examples include hydroentagled (sometimes called spunlace), DRC (double re-creped), airlaid, spunbond, carded, paper towel, and meltblown sheet products. Further, sheet products may contain fibrous cellulosic materials that may be derived from natural sources, such as wood pulp fibers, as well as other fibrous material characterized by having hydroxyl groups attached to the polymer backbone. These include glass fibers and synthetic fibers modified with hydroxyl groups. Examples of sheet products include, but are not limited to, wipers, napkins, tissues, rolls, towels or other fibrous, film, polymer, or filamentary products.

In general, sheet products are thin in comparison to their length and breadth and exhibit a relatively flat planar configuration and are flexible to permit folding, rolling, stacking, and the like. The sheet product may have perforations extending in lines across its width to separate individual sheets and facilitate separation or tearing of individual sheets from a roll or folded arrangement at discrete intervals. Individual sheets may be sized as desired to accommodate the many uses of the sheet products. For example, perforation lines may be formed every 10 cm, or other defined interval, to define a universally sized sheet. Multiple perforation lines may be provided to allow the user to select the size of sheet depending on the particular need.

FIG. 1 illustrates a perspective, partially transparent view of an exemplary embodiment of a sheet product dispenser (dispenser) 100. The dispenser 100 includes a housing portion 102 that may include a removable or pivotable cover portion 104 that allows access to an internal cavity space defined by the housing portion 102. The cavity space is operative to receive a roll of sheet product (described below) for rotation about an axis. In the illustrated example, the cover portion 104 is merely an example, and may be sized and shaped in any alternate configuration. The dispenser 100 includes a spindle portion 106 that is disposed in the cavity space. The spindle portion 106 is removably mounted and supported at distal ends of the spindle portion 106 by engagement features. In the illustrated embodiment, the spindle portion 106 is mounted to facilitate the rotation of the spindle portion 106 about an axis of rotation defined by the longitudinal axis of the spindle portion. However, in alternate embodiments, the spindle portion 106 may be mounted such that the spindle portion 106 may be impeded from rotation about the longitudinal axis. The illustrated embodiment includes an orifice 108 defined by the housing portion 102. The orifice 108 provides a path for a sheet product (described below) to pass through and thus, be exposed and accessible to a user. A tear bar (not shown) may be arranged proximate to the orifice 108 to facilitate the separation of a portion of the sheet product from a roll of sheet product mounted on the spindle portion 106.

The dispenser 100 includes a load inducement portion 110. The load inducement portion 110 includes a load member 112 and a guide portion that includes guide members 114. The load member 112 is slidably engaged with the guide members 114 such that the load member 112 may slide along a path defined by the guide members 114 due to the force of gravity. The load member 112 includes a contact portion 118 that is operative to contact and apply a load to an outer surface of a roll of sheet product.

Figure 2A:
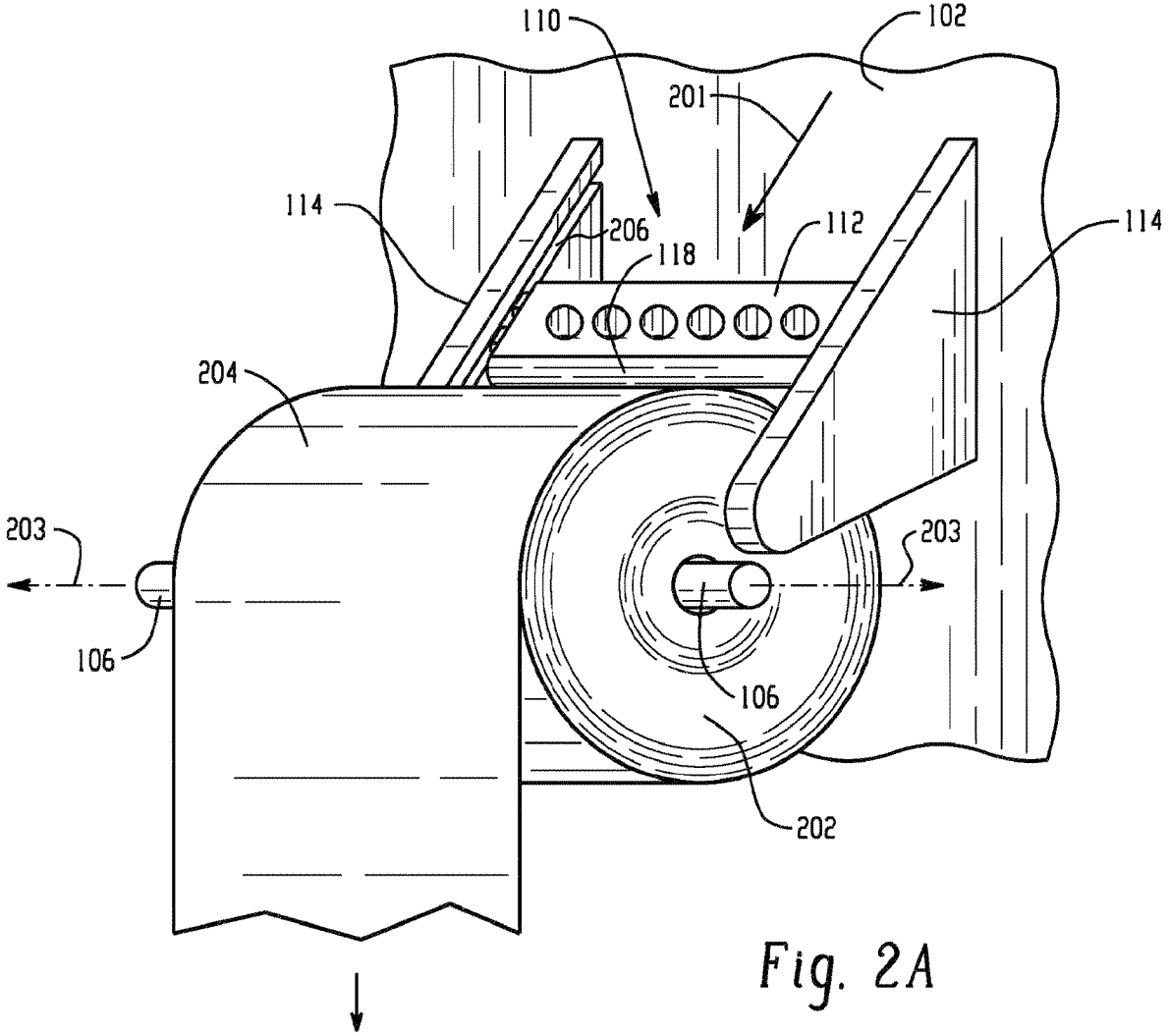
FIG. 2A illustrates a perspective view of a roll of sheet product mounted to the sheet product dispenser of FIG. 1.

FIG. 2A illustrates a perspective view of a roll of sheet product (roll) 202 that is mounted to the dispenser 100. Specifically, the roll 202 is mounted to the spindle portion 106 of the dispenser 100 such that the spindle portion 106 passes through an orifice defined by the roll 202. In the illustrated embodiment, the roll 202 and the load inducement portion 110 are arranged such that a portion of the roll 202 is disposed between the guide members 114. The contact portion 118 of the load member 112 contacts and applies a load to a portion of the outer surface 204 of the roll 202. As discussed above, the load member 112 slidably engages the guide members 114. The force of gravity biases the load member 112 to travel along channels 206 of the guide members 114 in the direction indicated by the arrow 201. The roll 202 impedes the travel of the load member 112 by exerting an opposing force on the load member 112. A frictional force is induced at the points of contact between the outer surface 204 of the roll 202 and the contact portion 118 of the load member 112. The frictional force opposes and affects the force that is applied by a user as the user draws sheet product from the roll 202, thereby rotating the roll 202 about the rotational axis 203 of the roll 202.

Figure 2B:
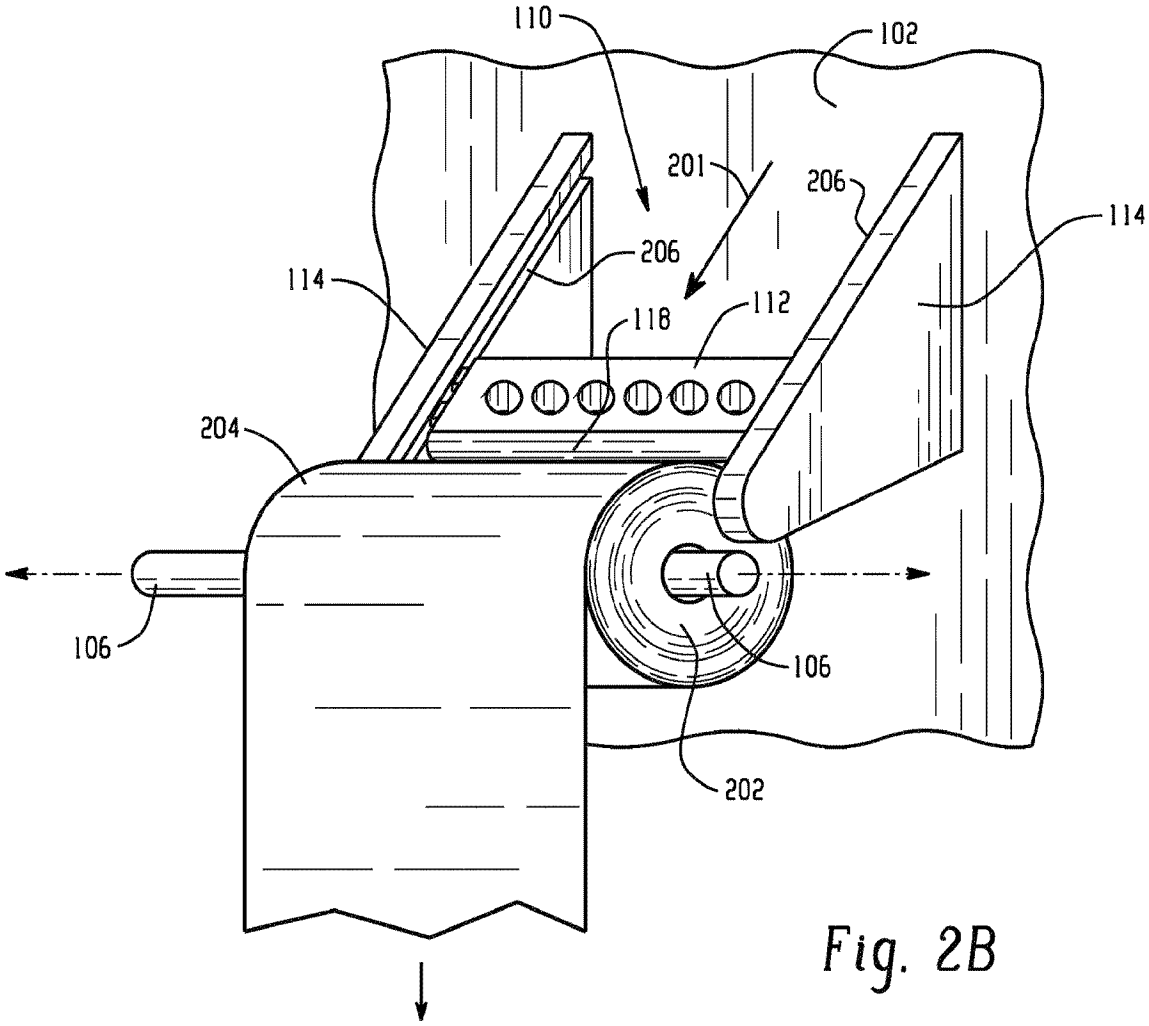
FIG. 2B illustrates a perspective view of the roll of sheet product and the sheet product dispenser of FIG. 2A following partial depletion of sheet product from the roll.

FIG. 2B illustrates a perspective view of the roll 202 and the dispenser 100 following partial depletion of sheet product from the roll 202. In this regard, the outer diameter and mass of the roll 202 have decreased following the removal of sheet product from the roll 202 for use by a user. As the outer diameter of the roll 202 is reduced, the load member 112 is driven by the force of gravity along a path defined by channels 206 of the guide members 114. The contact portion 118 remains in contact with and applies the load to the outer surface 204 of the roll 202 while the roll 202 is static (i.e., is not being rotated by a user withdrawing sheet product) and while the roll 202 is rotating.

Figure 3A:
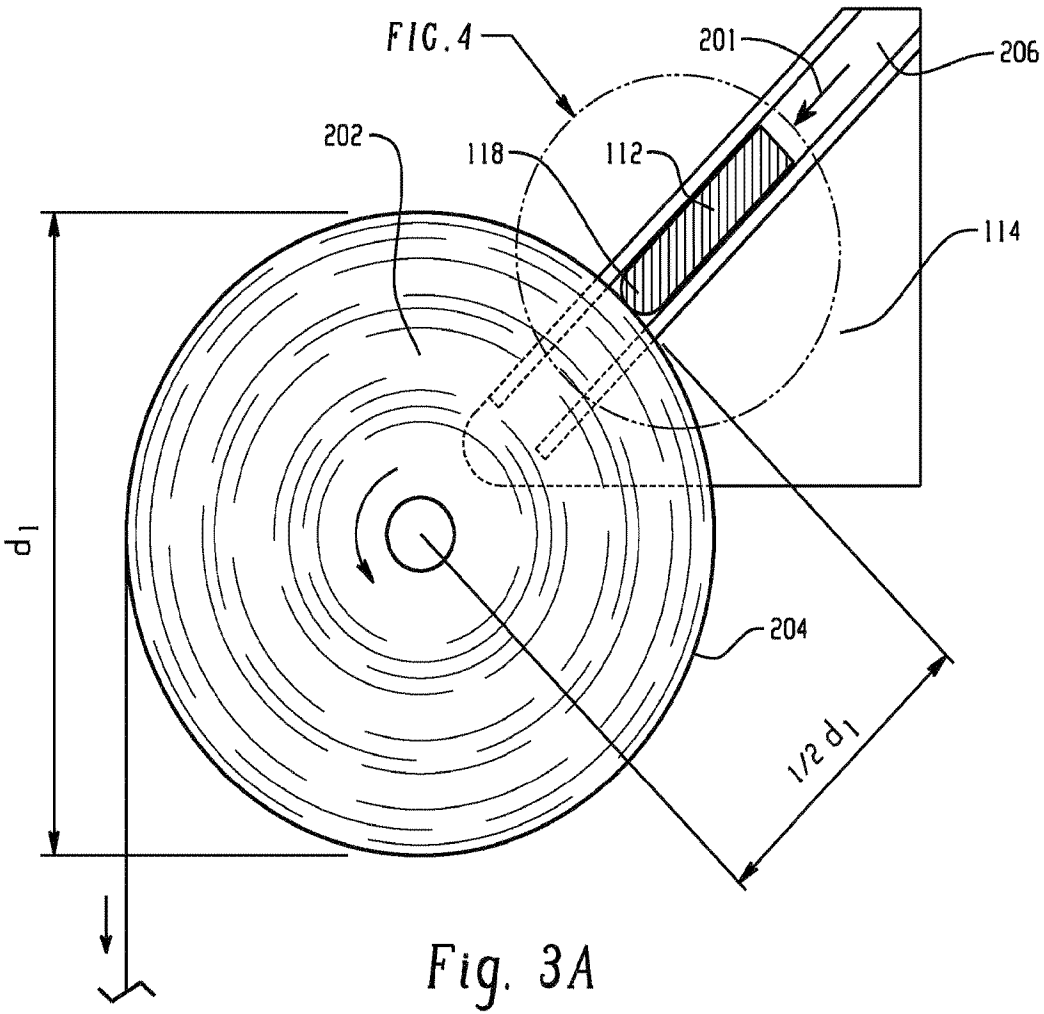
FIG. 3A illustrates a side view of the roll of sheet product and the sheet product dispenser of FIG. 2A, where the guide member is partially transparent.

FIG. 3A illustrates a side view of the roll 202 and the dispenser 100, where the guide member 114 is partially transparent. In this regard, the roll 202 has an outer diameter of $d_1$ and a radius of $\frac{1}{2}d_1$. The contact portion 118 of the load member 112 contacts and is impeded by the outer surface 204 of the roll 202.

Figure 3B:
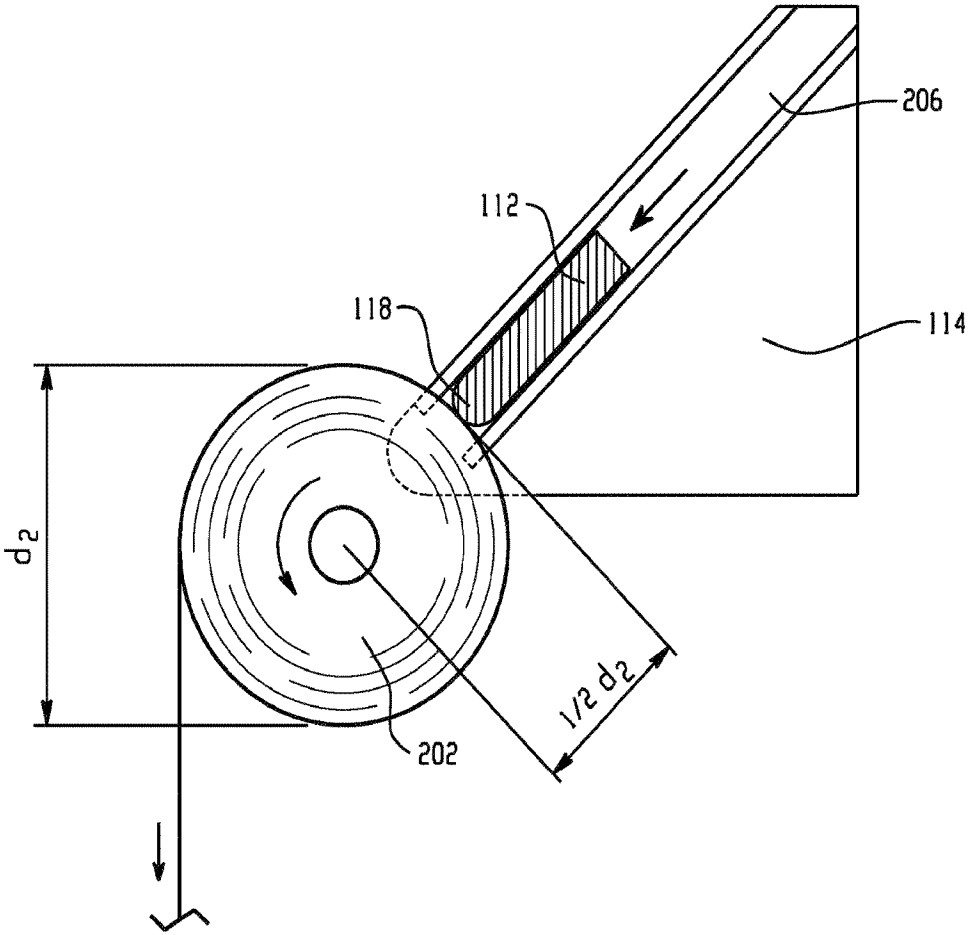
FIG. 3B illustrates a side view of the roll of sheet product and the sheet product dispenser of FIG. 2B, where the guide member is partially transparent.

FIG. 3B illustrates a side view of the roll 202 and the dispenser 100 following partial depletion of sheet product from the roll 202, where the guide member 114 is partially transparent. In comparison to FIG. 3A, the roll 202 has been partially depleted by a user such that the outer diameter of the roll is $d_2$, where $d_1>d_2$. The load member 112 has moved along the path defined by the channels 206 while remaining in contact with and applying the load to the outer surface 204 of the roll 202. Thus, as the outer diameter of the roll 202 is reduced, the load member 112 remains in contact with and applies a substantially constant load to the outer surface 204 of the roll 202 due to the force of gravity. In this manner, as the outer diameter of the roll 202 is reduced, the load member 112 induces a substantially constant frictional force between the roll 202 and the load member 112 due to the force of gravity. As used herein, the term "substantially" takes into consideration slight variations that may occur in the coefficient of friction between the load member 112 and the sheet product, such as at a perforation line in the sheet product for example. Other configurations may be employed that result in a change in the load applied by the load member 112 to the roll 202 and thus the frictional force induced between the load member 112 and the outer surface 204 of the roll 202 as the roll 202 is depleted, which are discussed in more detail below in connection with FIGS. 6-8.

Figure 4:
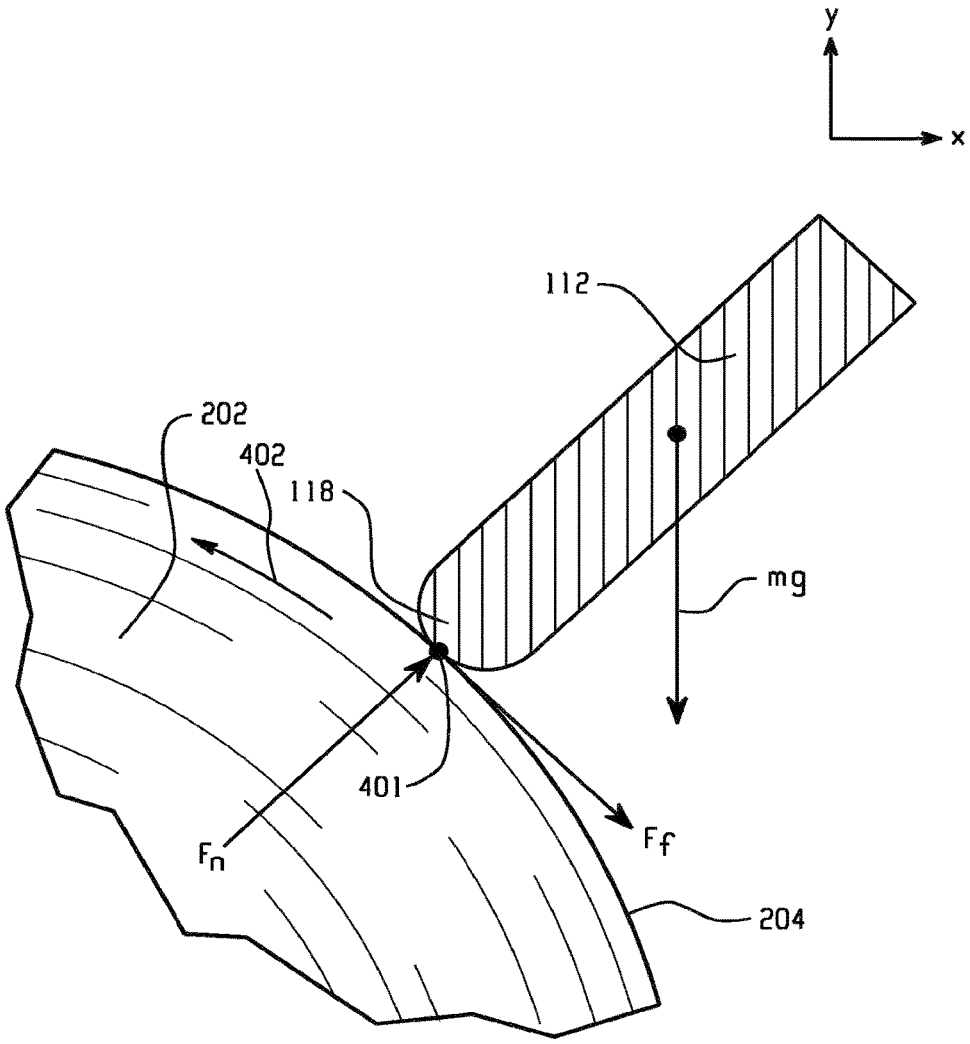
FIG. 4 illustrates a detailed side view of the arrangement of the load member and the roll of sheet product in Region 4 of FIG. 3A.

FIG. 4 illustrates a detailed side view of the arrangement of the load member 112 and the roll 202 in Region 4 (of FIG. 3A). The line mg represents a vector of the force of gravity acting on the load member 112 where m is the mass of the load member 112 and g is the acceleration due to gravity. The line $F_n$ represents a vector of the normal force exerted by the roll 202 and the load member 112 at the point 401 where the load member 112 contacts the roll 202. The line $F_f$ represents a vector of the force of friction resulting from rotational movement of the roll 202 in the direction indicated by the arrow 402. In this regard, the $F_f=\mu F_n$ where pi is the coefficient of friction of the sheet product on the roll 202 and the contact portion 118 of the load member 112.

The frictional force $F_f$ affects the amount of force a user may use to draw sheet product from the roll 202 and overspin of the roll. In this regard, once allowing for other effective forces, such as, for example, frictional forces on the rotation of the spindle 106 (of FIG. 1) or frictional forces on the rotation of the center of the roll 202 about the spindle 106 (for embodiments where the spindle 106 remains in a fixed orientation as the roll 202 rotates about the spindle 106), the frictional force $F_f$ may be chosen to provide a desired resistance felt by a user as the user draws sheet product from the roll 202. Thus, the mass of the load member 112, and the coefficient of friction may be selected to result in a desired frictional force $F_f$. The coefficient of friction may be determined in part by the coefficient of friction of the sheet product. The materials used in the contact portion 118 of the load member may also affect the coefficient of friction. The surface of the contact portion 118 may also be smooth, or in some embodiments, may include perturbations, patterns, or ridges that are operative to affect the coefficient of friction. The layers of sheet material on the roll 202 are affected by the normal force $F_n$ and thus have a respective force of friction between them. The frictional force $F_f$ between the outer surface 204 of the roll 202 and the load member 112 may be selected such that the frictional force $F_f$ is not greater than the force of friction between two layers of sheet products on the roll 202 to avoid undesirable unwinding of the roll 202 in the dispenser 100.

Figure 5:
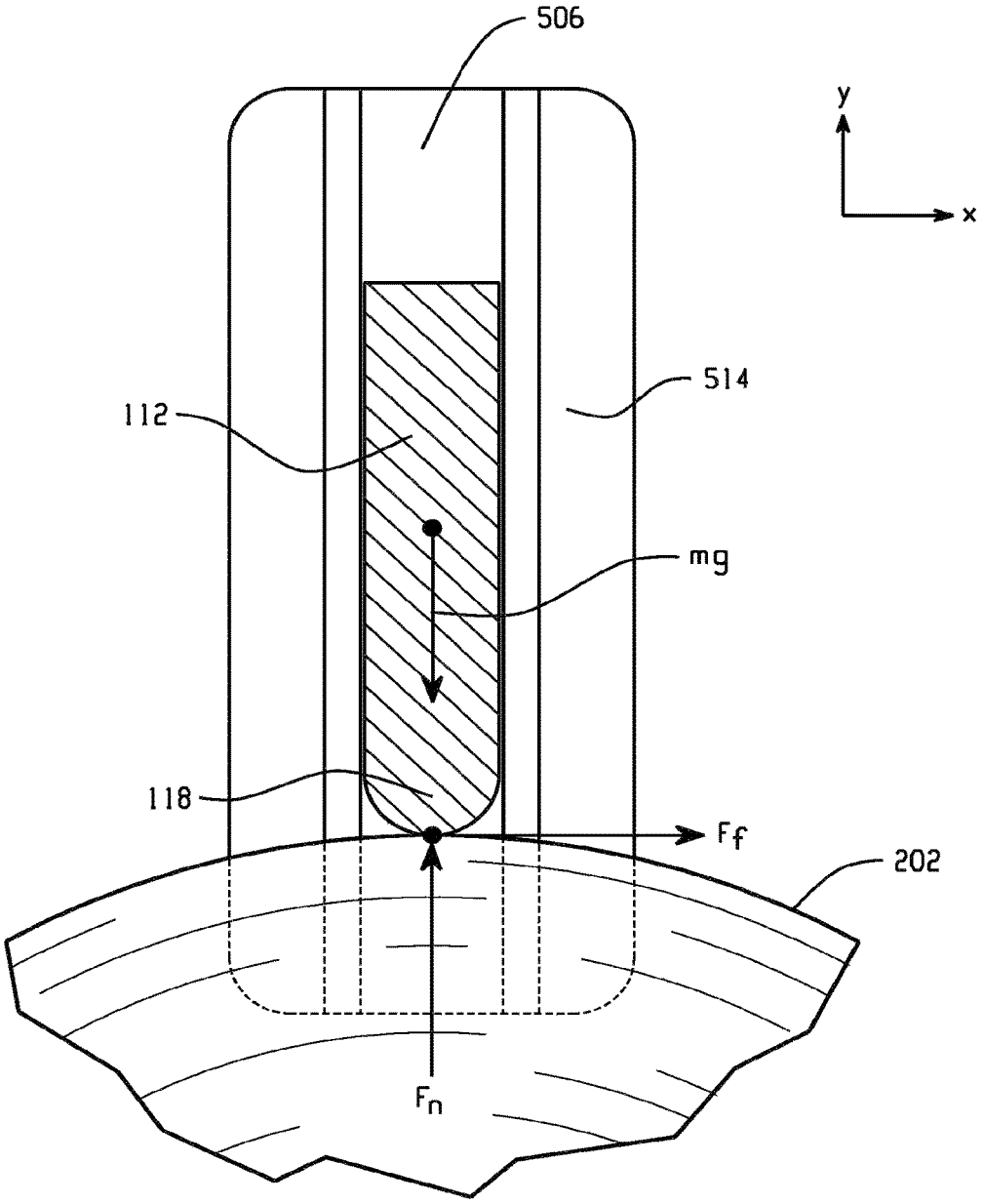
FIG. 5 illustrates a side view of an alternate exemplary embodiment of a guide member of a sheet product dispenser and a roll of sheet product.

FIG. 5 illustrates a side view of an alternate exemplary embodiment of a guide member 514 of the dispenser 100. The guide member 514 has guides 506 that may include, for example, a channel or other feature operative to slidably engage the load member 112. In this regard, the guides 506 are operative to arrange the load member 112 such that the force mg due to gravity is substantially collinear with the normal force $F_n$. The illustrated embodiment demonstrates how the angle of incidence of the load member 112 on the roll 202 may include any angle operative to affect a desired normal force $F_n$ due to gravity acting on the load member 112. The normal force $F_n$ affects the frictional force $F_f$ according to the equation $F_f=\mu F_n$.

Figure 6:
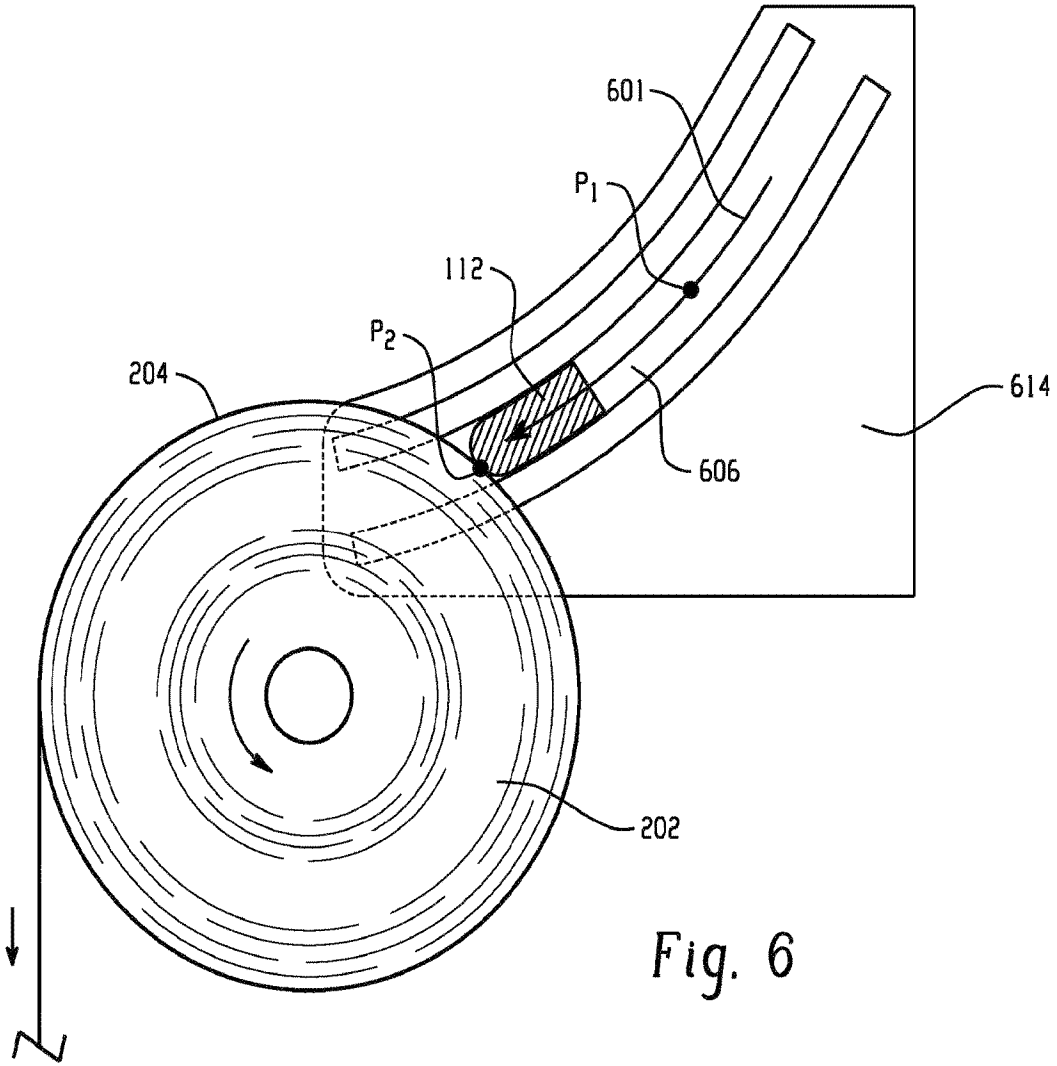
FIG. 6 illustrates a side view of another alternate exemplary embodiment of a guide member of a sheet product dispenser and a roll of sheet product.

FIG. 6 illustrates a side view of another alternate exemplary embodiment of a guide member 614 of the dispenser 100. The guide member 614 includes guides 606 having a curved profile such that the angle of incidence of the load member 112 relative to the outer surface 204 of the roll 202 changes as the load member 112 follows the path indicated by the arrow 601. In this regard, the angle of incidence is decreased at the position $P_2$ relative to the position $P_1$.

Figure 7B:
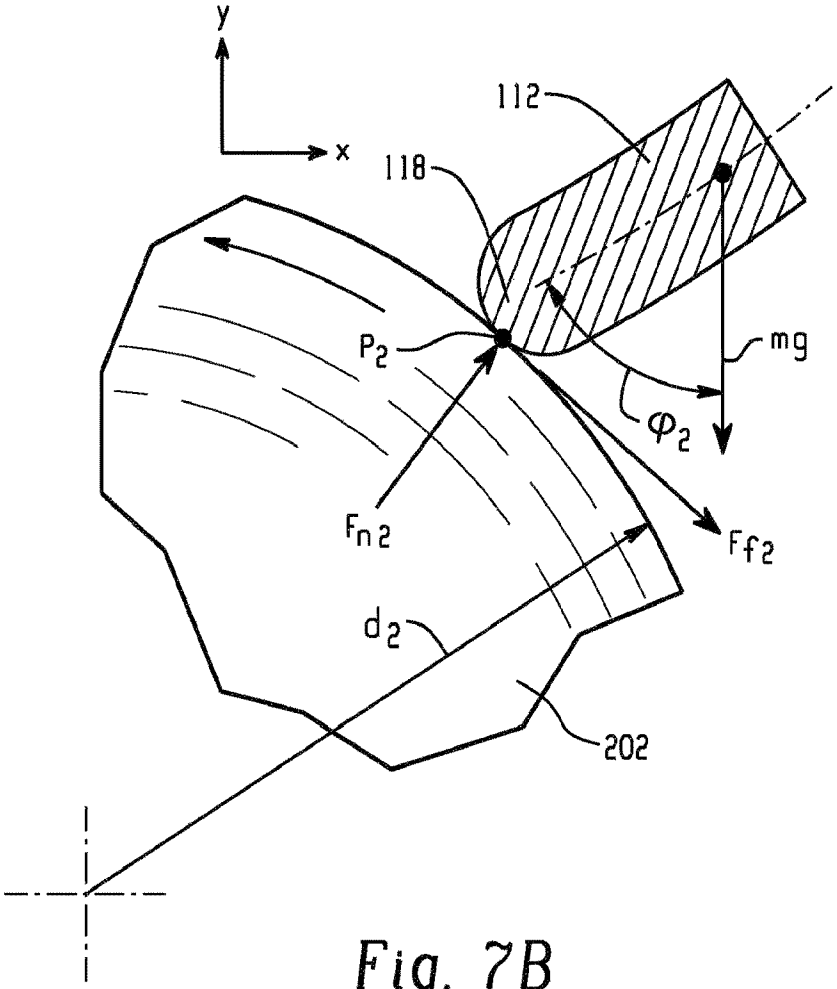
FIGS. 7A and 7B illustrate detailed side views of the arrangement of the load member and the roll of sheet product of FIG. 6.
Figure 7A:
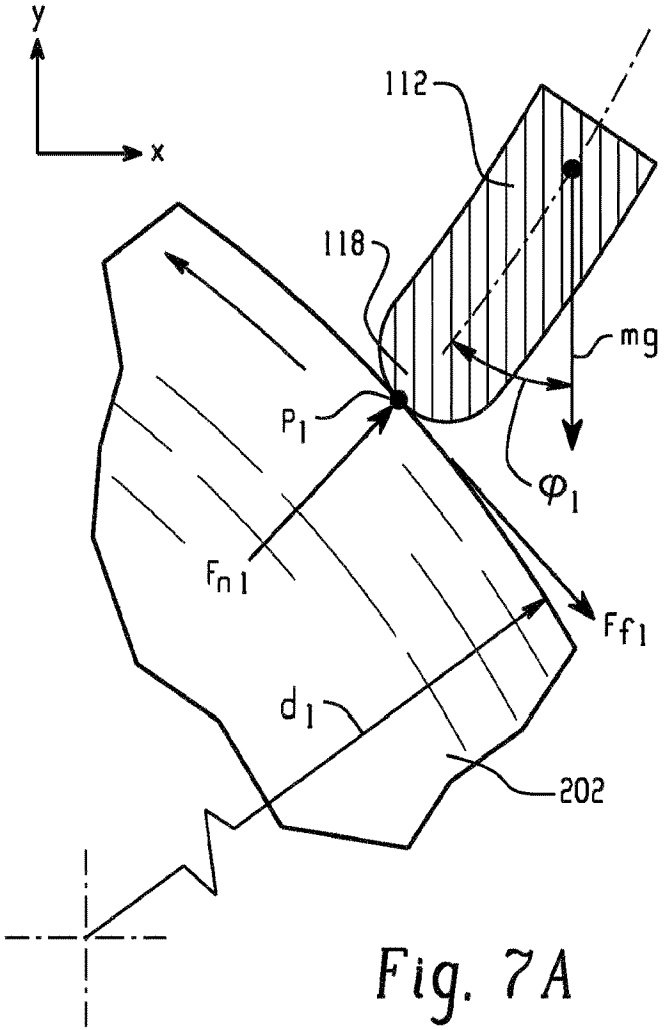

FIGS. 7A and 7B illustrate detailed side views of the arrangement of the load member 112 and the roll 202, showing the operation of the embodiment described above in FIG. 6. In this regard, FIG. 7A illustrates a roll 202 having a diameter $d_1$. The contact portion 118 of the load member 112 is in the position $P_1$ (of FIG. 6). The resultant normal force ($F_{n1}$), frictional force ($F_{f1}$), and angle ($\varphi_1$) defined by normal force $F_{n1}$ and weight of the member mg are shown. FIG. 7B illustrates the roll 202 having a diameter $d_2$ where $d_1>d_2$. The contact portion 118 of the load member 112 is in the position $P_2$ (of FIG. 6). The resultant normal force ($F_{n2}$), frictional force ($F_{f2}$), and angle ($\varphi_2$) defined by the normal force $F_{n2}$ and weight of the member mg are shown. The angle $\varphi_2$ is greater than the angle $\varphi_1$, which results in the normal force $F_{n1}$ being greater than the normal force $F_{n2}$ and the frictional force $F_{f1}$ being greater than the frictional force $F_{f2}$. Such a difference in the $F_f$ may be desired to affect the feel experienced by a user when the diameter of the roll 202 is reduced.

Figure 8:
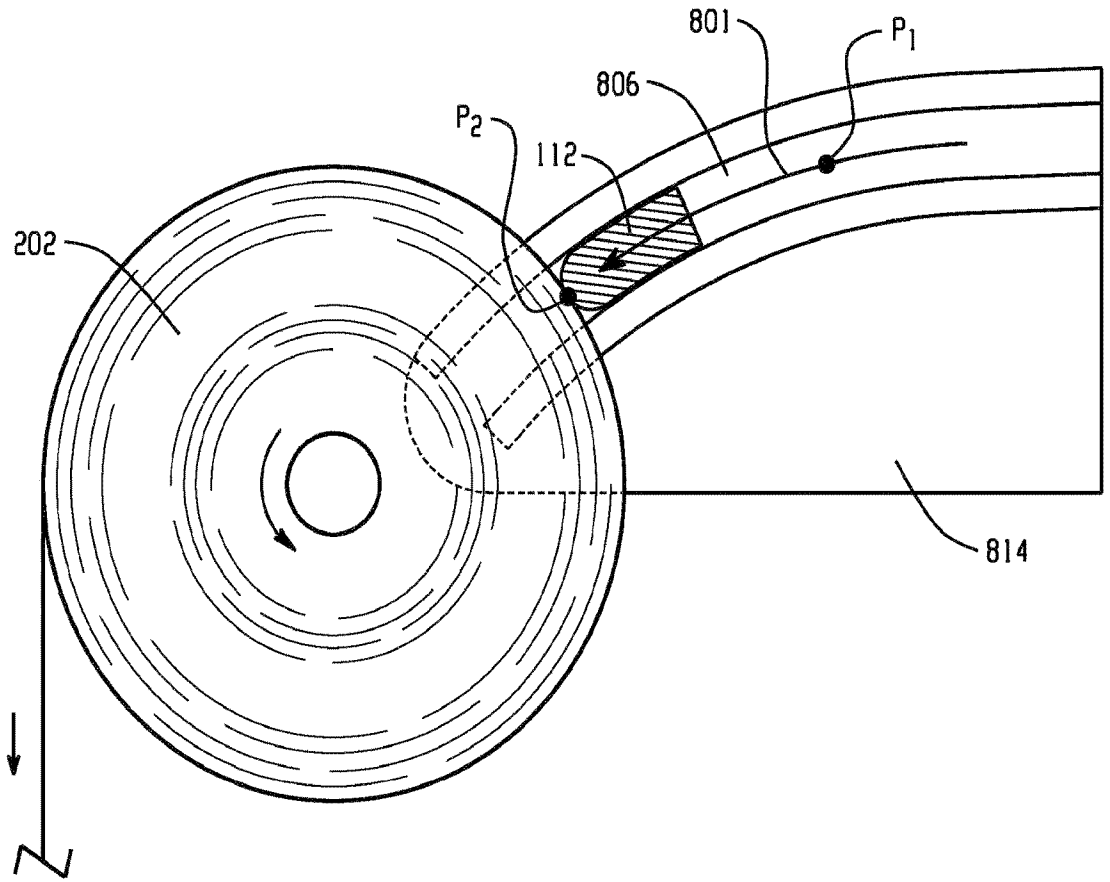
FIG. 8 illustrates a side view of another alternate exemplary embodiment of a guide member of a sheet product dispenser and a roll of sheet product.

FIG. 8 illustrates a side view of another alternate exemplary embodiment of a guide member 814 of the dispenser 100. The guide member 814 includes guides 806 having a curved profile such that the angle of incidence of the load member 112 relative to the outer surface 204 of the roll 202 changes as the load member 112 follows the path indicated by the arrow 801. In this regard, the angle of incidence is increased at the point $P_2$ relative to the point $P_1$. Thus, the resultant $F_f$ at point $P_1$ is less than the $F_f$ at point $P_2$ when the load member 112 contacts the roll 202 at the respective points.

The embodiments of the sheet product dispenser described herein provide an improved configuration for reducing overspin of a roll of sheet product. As described above, the sheet product dispenser includes a load inducement portion operative to contact and apply a load to an outer surface of the roll of sheet product due to a force of gravity. In this manner, the load inducing portion is operative to induce a frictional force between the roll of sheet product and the load inducement portion during rotation of the roll of sheet product, which reduces overspin. Further, the frictional force generated affects the force applied by a user to dispense sheet product from the roll of sheet product, which may reduce sheet product consumption per usage occasion.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A sheet product dispenser for dispensing a roll of sheet product mounted thereto, the dispenser comprising:

a housing portion defining a space operative to receive the roll of sheet product for rotation about an axis to dispense the sheet product; and a load inducement portion operative to induce a frictional force between the roll of sheet product and the load inducement portion during rotation of the roll of sheet product, the load inducement portion comprising:

a guide member defining a channel having a first end and a second end; and a load member engaged with the guide member and operative to slide along the channel from the first end to the second end due to a force of gravity, the load member comprising:

a contact portion defined along a first side of the load member and having a curved shape, the contact portion operative to contact and apply a load to an outer surface of the roll of sheet product due to the force of gravity; and a non-contact portion defined along a second side of the load member opposite the first side of the load member;

wherein the load member is engaged with the guide member such that the contact portion remains oriented toward the roll of sheet product as the load member slides along the channel from the first end to the second end and during rotation of the roll of sheet product and such that the non-contact portion remains oriented away from the roll of sheet product as the load member slides along the channel from the first end to the second end and during rotation of the roll of sheet product; and wherein the load inducement portion is operative such that the load applied by the contact portion due to the force of gravity continuously changes as the load member slides along the channel from the first end to the second end.

2. The sheet product dispenser of claim 1, wherein the channel defines a curved profile extending from the first end to the second end.

3. The sheet product dispenser of claim 1, wherein the load member is operative such that the contact portion remains in contact with and applies the load to the outer surface of the roll of sheet product during rotation of the roll of sheet product.

4. The sheet product dispenser of claim 1, wherein the load applied by the contact portion due to the force of gravity continuously decreases as the load member slides along the channel from the first end to the second end.

5. The sheet product dispenser of claim 1, wherein the load applied by the contact portion due to the force of gravity continuously increases as the load member slides along the channel from the first end to the second end.

6. The sheet product dispenser of claim 1, wherein the frictional force is less than a force of friction between two layers of the roll of sheet product.

7. The sheet product dispenser of claim 1, wherein the load inducement portion comprises two guide members, wherein the load member is formed as an elongated bar, and wherein a respective end of the load member is engaged with each of the guide members.

8. The sheet product dispenser of claim 7, wherein the guide members are operative to receive a portion of the roll of sheet product between the guide members.

9. A sheet product dispenser for dispensing a roll of sheet product mounted thereto, the dispenser comprising:

a housing portion defining a space operative to receive the roll of sheet product;

a roll support operative to support the roll of sheet product for rotation about a fixed axis relative to the housing portion to dispense the sheet product; and a load inducement portion comprising:

a guide member defining a channel having a first end and a second end; and a load member operative to slide along the channel from the first end to the second end and to contact and apply a load to an outer surface of the roll of sheet product due to a force of gravity, wherein the load inducement portion is operative such that the load applied by the load member due to the force of gravity continuously changes as the load member slides along the channel from the first end to the second end.

10. The sheet product dispenser of claim 9, wherein the load member is operative to remain in contact with and apply the load to the outer surface of the roll of sheet product due to the force of gravity during rotation of the roll of sheet product.

11. The sheet product dispenser of claim 9, wherein the roll support comprises a spindle.

12. The sheet product dispenser of claim 9, wherein the load inducement portion is operative such that the load applied by the load member due to the force of gravity continuously decreases as the load member slides along the channel from the first end to the second end.

13. A method of dispensing a roll of sheet product mounted to a sheet product dispenser, the method comprising:

supporting the roll of sheet product for rotation about a fixed axis relative to a housing portion of the sheet product dispenser;

contacting and applying a load to an outer surface of the roll of sheet product with a load inducement portion of the sheet product dispenser due to a force of gravity, the load inducement portion comprising:

a guide member defining a channel having a first end and a second end; and a load member operative to slide along the channel from the first end to the second end; and rotating the roll of sheet product about the fixed axis within a space defined by the housing portion to dispense the sheet product;

wherein the load applied by the load inducement portion due to the force of gravity continuously changes as the load member slides along the channel from the first end to the second end.

14. The method of claim 13, wherein rotating the roll of sheet product comprises allowing the load inducement portion to move to remain in contact with and apply the load to the outer surface of the roll of sheet product due to the force of gravity.

15. The method of claim 13, wherein supporting the roll of sheet product comprises supporting the roll of sheet product with a roll support of the sheet product dispenser.

16. The method of claim 14, wherein the load applied by the load inducement portion due to the force of gravity continuously decreases as the load member slides along the channel from the first end to the second end.

17. The sheet product dispenser of claim 1, further comprising a roll support operative to support the roll of sheet product for rotation about the axis, wherein the axis is fixed relative to the housing portion.

18. The sheet product dispenser of claim 1, wherein the guide member is fixed relative to the housing portion and positioned within the space defined by the housing portion.

19. The sheet product dispenser of claim 1, wherein the load member is keyed to the guide member such that the contact portion remains oriented toward the roll of sheet product as the load member slides along the channel from the first end to the second end and during rotation of the roll of sheet product and such that the non-contact portion remains oriented away from the roll of sheet product as the load member slides along the channel from the first end to the second end and during rotation of the roll of sheet product.

20. The sheet product dispenser of claim 1, wherein the load member is engaged with the guide member such that the load member does not rotate with respect to the guide member as the load member slides along the channel from the first end to the second end and during rotation of the roll of sheet product.

21. The sheet product dispenser of claim 1, wherein an end portion of the load member is received within the channel, and wherein the load member is engaged with the guide member such that the load member does not rotate with respect to the channel as the load member slides along the channel from the first end to the second end and during rotation of the roll of sheet product.

22. The sheet product dispenser of claim 1, wherein a longitudinal axis of the load member is oriented parallel to the axis of rotation of the roll of sheet product.

* * * * *